US007025328B2

(12) United States Patent
Ulicny et al.

(10) Patent No.: US 7,025,328 B2
(45) Date of Patent: Apr. 11, 2006

(54) DAMPER ACTUATOR SYSTEM

(75) Inventors: Dennis J. Ulicny, Waukesha, WI (US); Carl D. Schrubbe, Waukesha, WI (US)

(73) Assignee: Johnson Controls Technology Company, Holland, MI (US)

( * ) Notice: Subject to any disclaimer, the term of this patent is extended or adjusted under 35 U.S.C. 154(b) by 113 days.

(21) Appl. No.: 10/875,421

(22) Filed: Jun. 24, 2004

(65) Prior Publication Data

US 2005/0287947 A1 Dec. 29, 2005

(51) Int. Cl.
*F16K 31/02* (2006.01)

(52) U.S. Cl. ..... 251/129.11; 251/250.5

(58) Field of Classification Search ..... 251/129.11, 251/129.12, 129.13, 248, 250.5, 304; 318/466
See application file for complete search history.

(56) References Cited

U.S. PATENT DOCUMENTS 5,000,212 A * 3/1991 Tervo ..... 137/1
5,647,399 A * 7/1997 Andersen ..... 137/637.3
6,015,142 A 1/2000 Ulicny
6,097,123 A 8/2000 Weiss et al.
6,495,981 B1 12/2002 Romanowich et al.

OTHER PUBLICATIONS

"M9206-Bxx-2S Series On/Off Electric Spring Return Actuators," Product Bulletin, Nov. 15, 2002, pp. 1-4, Code No. LIT-0120110, Johnson Controls, Inc.
"M9216 Series Electric Spring Return Actuators," Oct. 2001, pp. 1-3, Code No. LIT-1922035, Johnson Controls, Inc.
"Damper Actuators and Accessories," 2003 Pricing Guide, Effective Oct. 1, 2003, 36 pages, F20380-08/03-10M-IG, Belimo Aircontrols (USA), Inc.
"Improving Life in the Great Indoors," Direct-Mount Electric Actuator, Jun. 2003, 34 pages, PUBL-3059, Johnson Controls, Inc., USA.

* cited by examiner

*Primary Examiner*—Edward K. Look
*Assistant Examiner*—John K. Fristoe, Jr.
(74) *Attorney, Agent, or Firm*—Foley & Lardner LLP

(57) ABSTRACT

A damper actuator includes a housing and a hub extending through and rotatably coupled to the housing. The actuator is configured to be a side-mount direct coupled actuator. In one embodiment, an external clamp is coupled to the housing and is configured to be attached to a damper shaft without the damper shaft extending through the hub. A torque transfer mechanism is coupled between the hub and the external clamp such that rotation of the hub results in a corresponding rotation of the damper shaft. In another embodiment, a channel in the actuator housing is configured to accept a damper shaft from the side and the hub includes a removable portion to allow for insertion and removal of the damper shaft.

29 Claims, 6 Drawing Sheets

DAMPER ACTUATOR SYSTEM

FIELD OF THE INVENTION

The present invention relates to electric damper actuators, such as the type used to operate dampers in a heating, ventilation, and air-conditioning (HVAC) system. In particular, the present invention relates to a damper actuator system that is configured to be directly mounted to a damper shaft from the end or the side of the damper shaft, depending on the needs of the user.

BACKGROUND OF THE INVENTION

The air flow in HVAC ducts in buildings is typically controlled by dampers. Dampers have a number of vanes that open and close and are placed in the air stream of the ducts to control the air flow. Dampers generally have a round shaft that is connected to the vanes. Rotating the shaft controls the position of the vanes to control the flow of air through the damper. Typically, the shaft is rotated approximately ninety degrees in one direction to open the damper and approximately ninety degrees in the opposite direction to close the damper. A damper actuator is used to rotate the shaft to open and close the damper. Damper actuators are typically electrically powered motorized devices that are connected to an HVAC control system. The HVAC control system sends electrical signals to the actuators to control the position of the dampers. Examples of damper actuators include M9206 Series and M9216 Series electric spring return actuators manufactured and sold by Johnson Controls, Inc.

A damper actuator generally has a housing with a hollow hub extending therethrough. A coupling device is provided to couple a damper shaft to the hub, allowing for damper shafts of differing sizes to be utilized with the same internal hub diameter. The hub is rotated by a motor to rotate the damper shaft, thus controlling the position of the damper. When the actuator is directly mounted to and typically supported by the damper shaft, the actuator is considered to be direct coupled to the damper shaft.

Conventional direct coupled actuators are typically installed by inserting a free end of the damper shaft through the hub and housing. Because an end of the shaft is inserted into or removed from the hub during installation or removal of the actuator, the actuator may be referred to as an end-mount actuator.

In very large ducts, multiple dampers are arranged side-by-side and above and below each other, typically with a shaft running through a row of several dampers. Mounting an end-mount direct coupled actuator between two dampers in a such a large duct situation requires that the shaft be threaded out of the dampers, the actuator properly mounted, and the shaft replaced. It is therefore difficult to service or replace an end-mount direct coupled actuator in a large duct because of the difficulty in removing the direct coupled actuator from the shaft.

It would be advantageous for a direct coupled damper actuator to be configured to be mounted to a damper shaft without requiring the removal or displacement of the damper shaft. Further, because direct coupled actuators are used in the majority of HVAC applications, it would be advantageous to provide a damper actuator system allowing a damper actuator to be utilized in either a end-mount fashion or in a configuration that does not require remount or displacement of the damper shaft during installation or removal.

It would be desirable to provide a system and/or method that provides one or more of these or other advantageous features. Other features and advantages will be made apparent from the present specification. The teachings disclosed herein extend to those embodiments that fall within the scope of the appended claims, regardless of whether they accomplish one or more of the aforementioned needs.

SUMMARY OF THE INVENTION

The invention relates to a damper actuator having a housing and a hub rotatably coupled to the housing, the hub defining an aperture through the housing. The damper actuator further includes a motor coupled to the hub to rotate the hub and an external clamp operatively coupled to the hub. A torque is transmitted from the hub to the external clamp, and the external clamp is configured to be attached to a damper shaft such that rotation of the hub results in a corresponding rotation of the damper shaft without the damper shaft extending through the aperture.

The invention further relates to a damper actuator system. The damper actuator system includes a damper actuator having a housing and a hub rotatably coupled to the housing, the hub defining an aperture through the housing. A first clamp is adapted to be directly coupled to the hub to operatively couple a damper shaft to the hub in a first configuration, the damper shaft extending through the aperture in the first configuration. A second clamp is adapted to be attached to the housing to operatively couple the damper shaft to the hub in a second configuration, the damper shaft extending through the second clamp without extending through the aperture in the second configuration. A torque is transmitted from the hub to the damper shaft via the first clamp in the first configuration and via the second clamp in the second configuration.

Further still, the present invention relates to a damper actuator having a housing and a hub rotatably coupled to the housing, the hub defining an aperture through the housing. A motor is coupled to the hub to rotate the hub. The damper actuator further includes a means for operatively coupling the hub to a damper shaft without the damper shaft extending through the aperture such that rotation of the hub results in a corresponding rotation of the damper shaft.

Further still, the present invention relates to a side-mount direct coupled damper actuator having a housing with a substantially U-shaped opening configured to receive a damper shaft from a side of the damper shaft. The actuator further includes a hub rotatably coupled to the housing, the hub having a first portion and a removable second portion, the first and second portions configured to capture the damper shaft. The actuator further includes a motor coupled to the hub to rotate the hub.

The invention is capable of other embodiments and of being practiced or being carried out in various ways. Alternative exemplary embodiments relate to other features and combination of features as may be generally recited in the claims.

BRIEF DESCRIPTION OF THE DRAWINGS

The invention will become more fully understood from the following detailed description, taken in conjunction with the accompanying drawings, wherein like reference numerals refer to like elements, in which.

DESCRIPTION OF PREFERRED EMBODIMENTS

Figure 2:
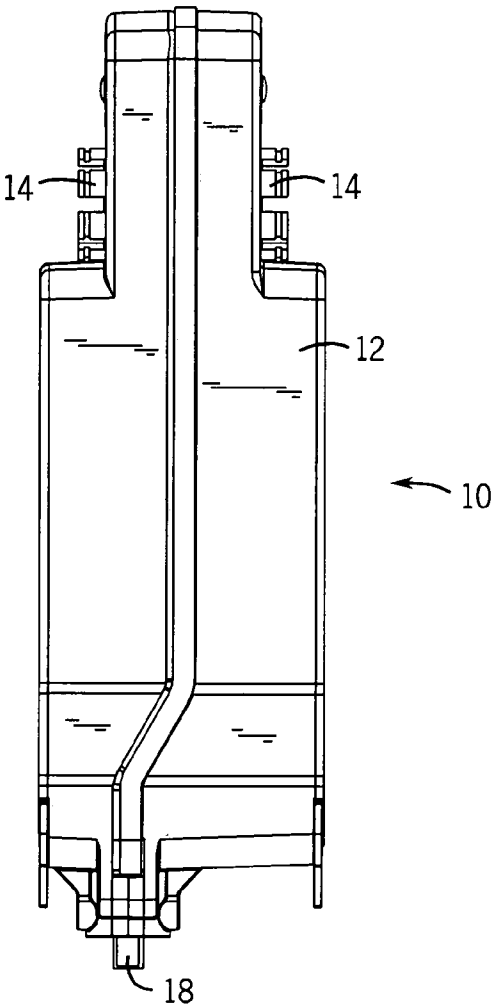
FIG. 2 is a side elevation view of the damper actuator of FIG. 1.
Figure 1:
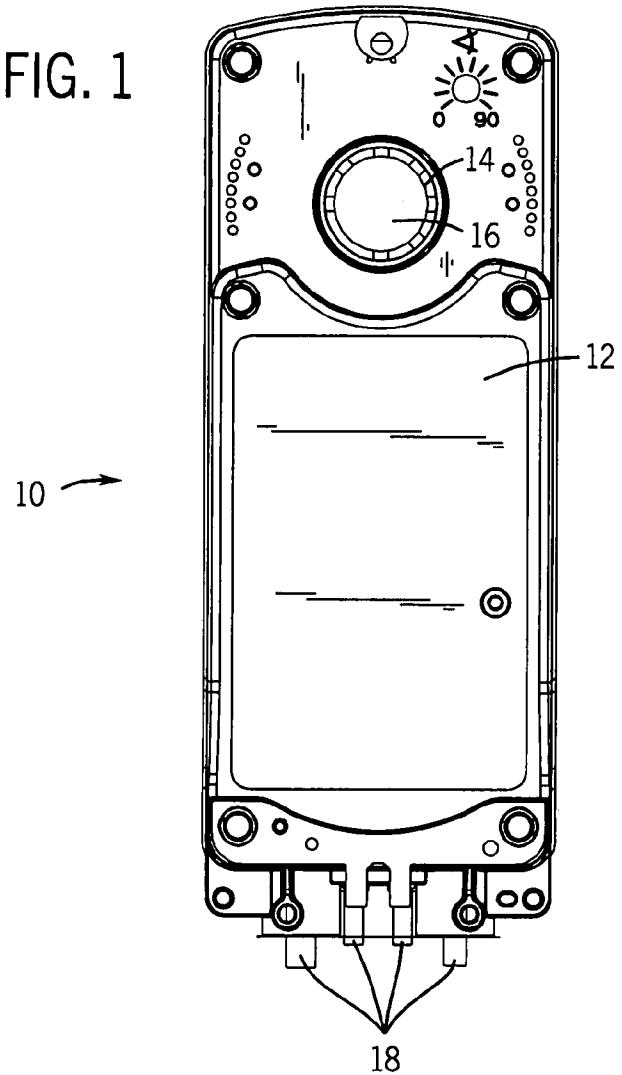
FIG. 1 is a front elevation view of a damper actuator.

Referring to FIGS. 1 and 2, a damper actuator 10 has a housing 12 and a rotatable hub, shown as, but not limited to hub 14, extending through the housing 12. The hub 14 has a through-hole or aperture 16 that is configured to receive a damper shaft (not shown in FIGS. 1 and 2) when the actuator 10 is used as an end-mount direct coupled actuator. A motor (not shown) is located within the housing 12 and provides a torque to rotate the hub 14. The actuator 10 has electrical terminals or leads 18 used to connect the actuator 10 to a power source and to receive control signals, among other uses.

The actuator 10 may be an electric spring return actuator that is used frequently in HVAC applications, but may also be any one of a number of HVAC actuators known in the art. Actuator 10 may be of the on/off variety having only fully opened and fully closed positions for the engaged damper, or may be a modulating actuator allowing the selection of many positions between the fully opened and fully closed positions to incrementally control air flow through the air duct.

Figure 4:
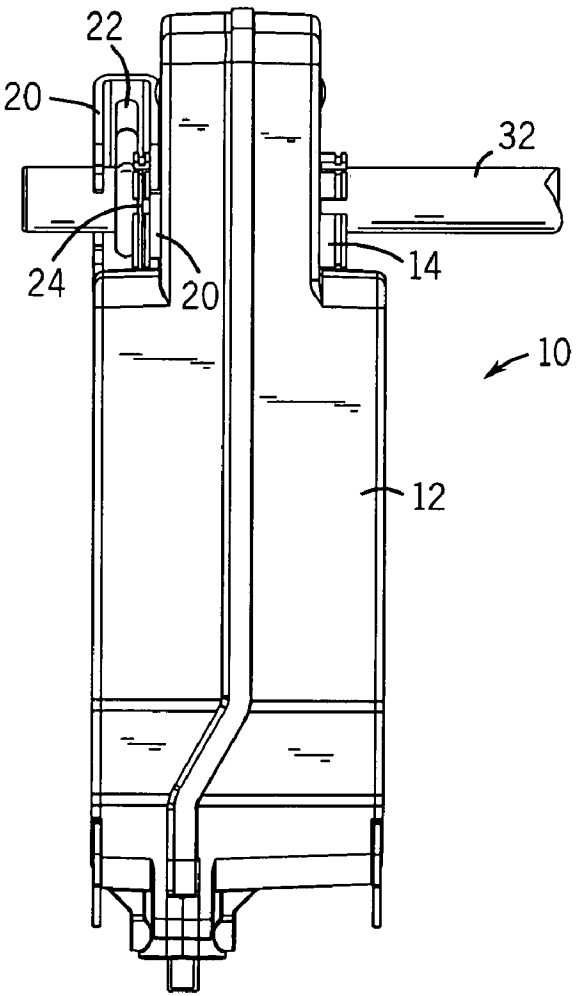
FIG. 4 is a side elevation view of the damper actuator and damper shaft (partially shown) of FIG. 3.
Figure 6:
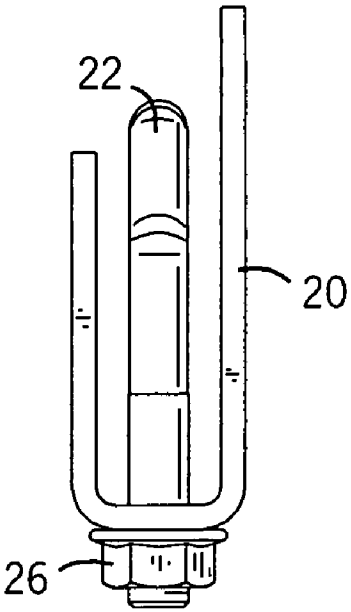
FIG. 6 is a side elevation view of the clamp of FIG. 5.
Figure 5:
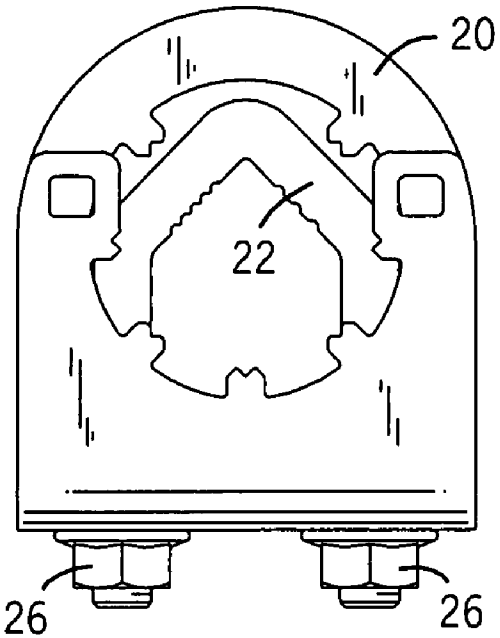
FIG. 5 is a front elevation view of the clamp of the damper actuator of FIG. 3.

Referring to FIGS. 3–6, actuator 10 may be used as an end-mount direct coupled actuator by utilizing a coupling clamp 20 and associated U-bolt 22 connected to the hub 14 by a retaining ring 24. In use, a damper shaft 32 is extended through the aperture 16 and is secured in place by the coupling clamp 20 and U-bolt 22. To accommodate shafts of differing sizes, the position of U-bolt 22 may be changed by adjusting nuts 26. FIGS. 5 and 6 show a more detailed view of the coupling clamp 20 and U-bolt 22 used in the embodiment of FIGS. 3 and 4.

Figure 8:
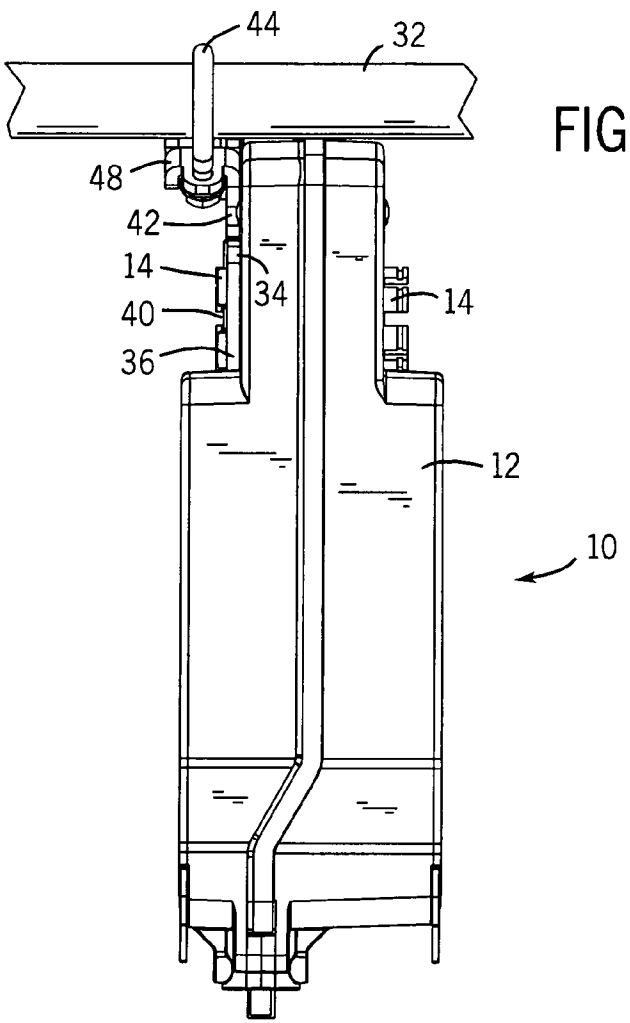
FIG. 8 is a side elevation view of the damper actuator and damper shaft (partially shown) of FIG. 7.
Figure 7:
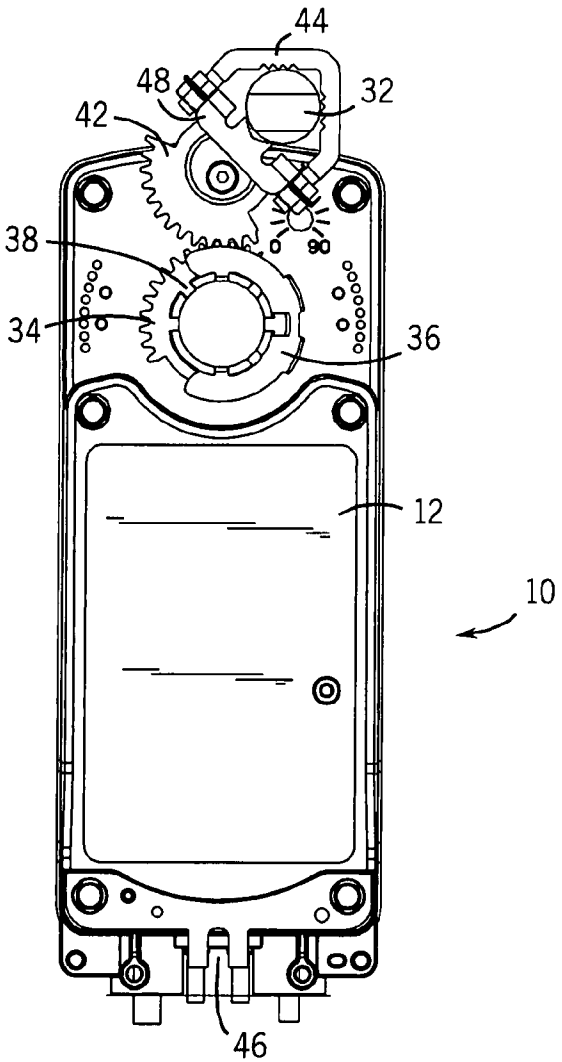
FIG. 7 is a front elevation view of a damper actuator coupled to a damper shaft.

Referring to FIGS. 7 and 8, in an exemplary embodiment, actuator 10 has a radial mounting kit or torque transfer mechanism that permits actuator 10 to be directly mounted to damper shaft 32 from the side. In order to turn the damper shaft 32 to open and close a damper, rotational movement must be translated from the hub 14 to the damper shaft 32 via the torque transfer mechanism that operatively couples the hub 14 to the damper shaft 32. In the embodiment of FIGS. 7 and 8, a hub gear 34 is coupled to the hub 14 and held in place by retaining ring 36. Although there are many ways to attach hub gear 34 to hub 14, in the embodiment shown in FIGS. 7 and 8, hub gear 34 has protrusions 38 that interlock with corresponding gaps 40 (see FIG. 8) in hub 14. The retaining ring 36 snaps onto hub 14 to further maintain hub gear 34 in place. Hub gear 34 may be a steel stamped gear that may be easily placed onto hub 14 during assembly of the torque transfer mechanism. Because the actuator 10 in the embodiment of FIGS. 7 and 8 may be mounted from the side of the damper shaft 32, and therefore does not require that an end of the damper shaft 32 be removed or installed through the hub 14, the actuator 10 maybe referred to as a side-mount direct coupled actuator as opposed to the end-mount direct coupled configuration shown in FIGS. 3 and 4.

Further referring to FIGS. 7 and 8, hub gear 34 interlocks with a second gear, shown as upper gear 42. Upper gear, like hub gear 34, may be a steel stamped gear. In the embodiment of FIGS. 7 and 8, an external clamp, shown as offset clamp 48, is integral with the upper gear 42, and the offset clamp 48 is coupled to damper shaft 32 via offset U-bolt 44. Accordingly, the torque from hub 14 is translated into rotation of damper shaft 32 via a gear train including hub gear 34, upper gear 42, and offset clamp 48.

The longitudinal axis of the damper shaft 32 remains radially stationary during rotation of shaft 32, so actuator 10 is configured to shift as damper shaft 32 is rotated by the torque transfer mechanism in the embodiment of FIGS. 7 and 8. To accommodate such movement, actuator 10 includes a slot 46 designed to receive an anti-rotational bracket (not shown) as is known in the art. The anti-rotational bracket and slot configuration is used by damper actuators in a direct coupled configuration as well because the damper shaft is often not the same radius as the hub (see FIG. 3) and accordingly eccentric rotation of the hub relative to the shaft results when the hub is rotated.

Figure 3:
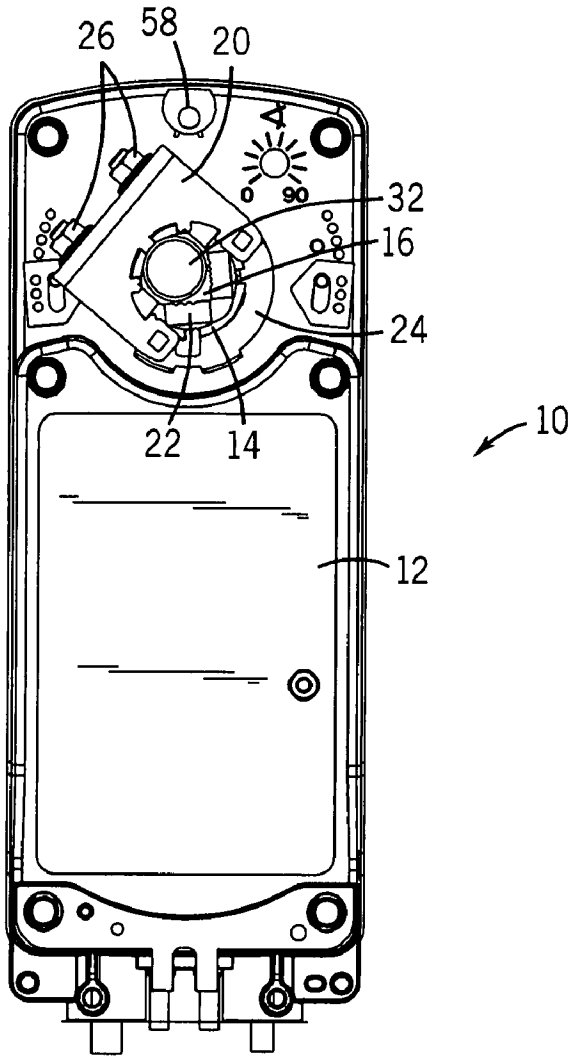
FIG. 3 is a front elevation view of a damper actuator coupled to a damper shaft.
Figure 11:
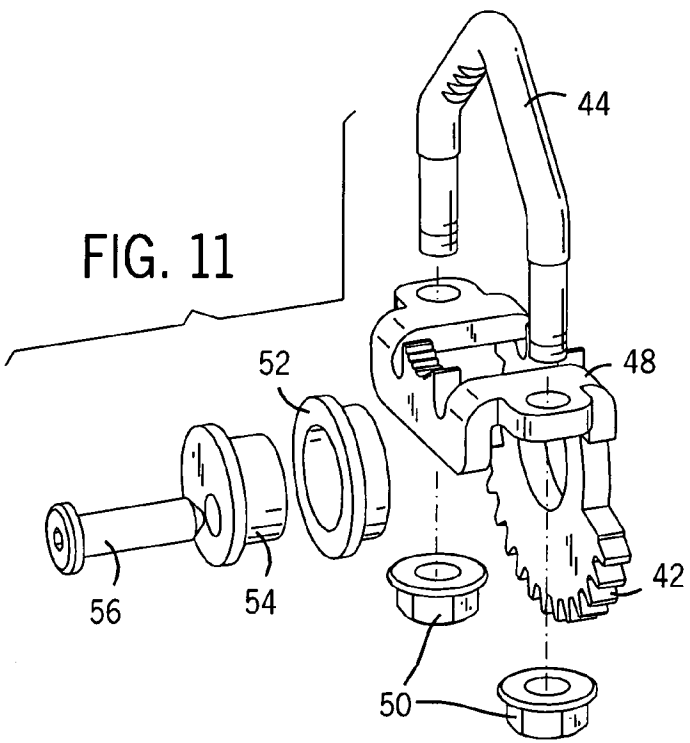
FIG. 11 is an exploded perspective view of the torque transfer mechanism of FIG. 9.
Figure 10:
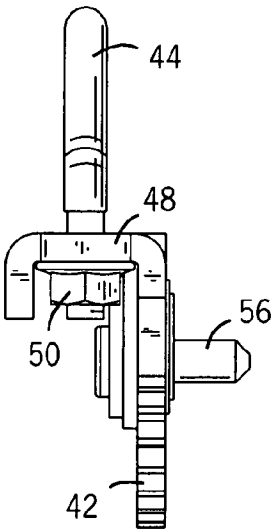
FIG. 10 is a side elevation view of the torque transfer mechanism of FIG. 9.
Figure 9:
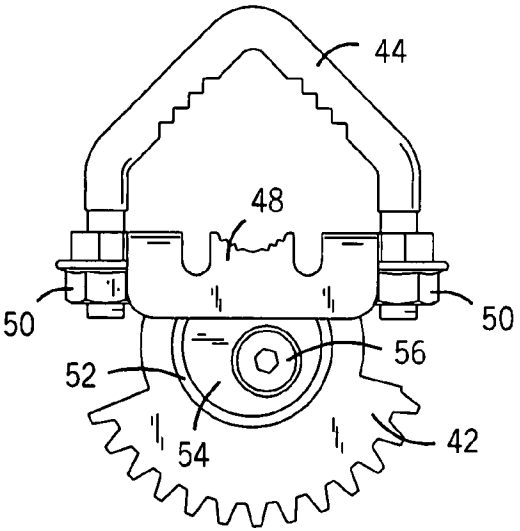
FIG. 9 is an elevation view of a portion of the torque transfer mechanism of the damper actuator of FIG. 7.

Referring to FIGS. 9–11, portions of the torque transfer mechanism according to an exemplary embodiment of the present invention are shown in greater detail. In particular, the U-bolt 44 is adjustable via adjustment of nuts 50. Such adjustment is necessary for offset clamp 48 to accommodate damper shafts of various sizes. Received within an aperture in upper gear 42 are bearing 52, upper gear hub 54, and attachment screw 56. Attachment screw 56 is received within a corresponding aperture 58 in the housing 12 (aperture 58 is shown in FIG. 3).

The actuator system shown and described with respect to FIGS. 1–11 allows greater flexibility to the user than is available with conventional damper actuators. In use, the user may begin by selecting an actuator type appropriate for the particular damper application. As discussed above, damper actuators are available in a variety of sizes, configurations, and having various features. The selected actuator may be similar to the actuator shown in FIGS. 1 and 2. Next, the user may select whether an end-mount or side-mount configuration is appropriate. An end-mount direct coupled configuration may be utilized when the air duct has a single damper with a shaft that may be easily shifted to permit insertion through the actuator housing. A side-mount direct coupled configuration may be appropriate where the shaft is difficult to remove, especially in large air ducts having multiple dampers aligned on a single shaft, creating difficulties with shaft removal.

Next, the user may select the orientation of the damper actuator. Because many electric damper actuators are of the spring-return type, returning the damper to a particular configuration when power is lost, the damper shaft must be installed with respect to the hub in the proper direction for the spring return, as is known in the art. Referring to FIGS. 4 and 8, note that the end-mount coupling components and the side-mount coupling components of the present invention may be installed on either side of the hub 14, depending on the chosen configuration of the actuator in the air duct and with respect to the damper shaft.

The user may then install the proper attachment components or hardware to permit the damper actuator to be used in either an end-mount or side-mount configuration depending on the needs of the user, while still utilizing the same basic actuator device. The hardware may include either end-mount components or side-mount components, such as those shown in FIGS. 5–6 and 9–11. In the end-mount configuration, the damper shaft 32 is installed through the actuator housing 12 as is known in the art and shown in FIG. 4. In the side-mount configuration, the actuator 10 may be installed on the damper shaft 32 without removing or displacing the damper shaft 32 by placing the base of the offset clamp 48 against the damper shaft 32 and installing the U-bolt 44 to accomplish the side-mount attachment as shown in FIG. 8. The actuator 10 may be secured within the air duct as is known in the art, depending on the desired application.

Figure 13:
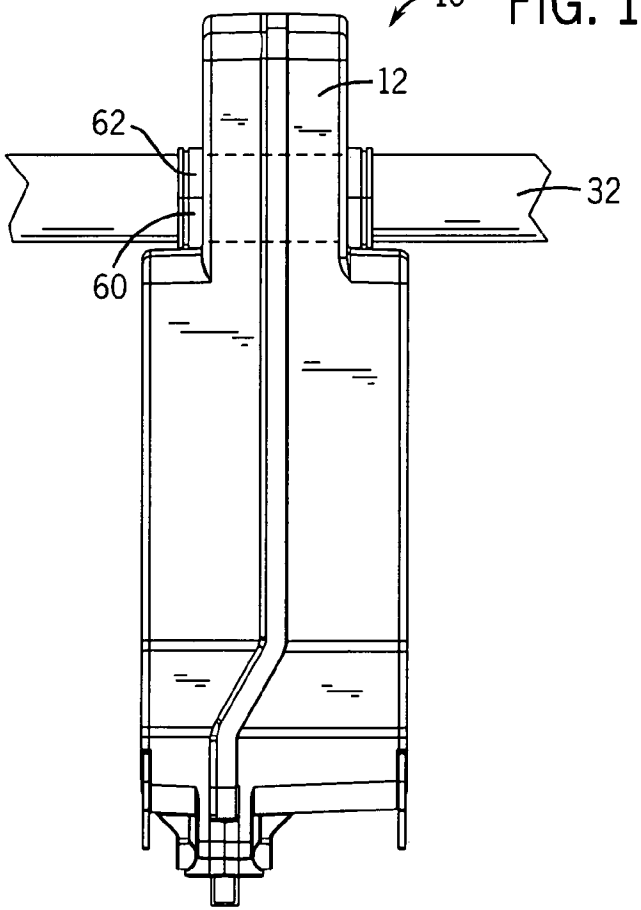
FIG. 13 is a side elevation view of the damper actuator of FIG. 12 coupled to a damper shaft (partially shown).
Figure 12:
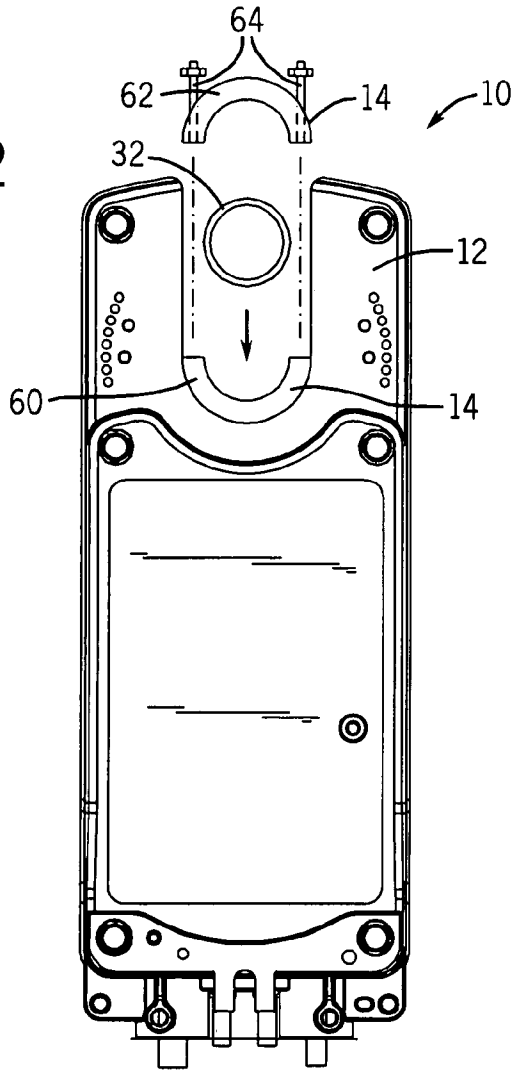
FIG. 12 is a partially exploded front elevation view of a damper actuator and a damper shaft.

Referring now to FIGS. 12 and 13, the actuator 10 is shown according to another exemplary embodiment of the invention. In particular, the housing 12 has a channel, shown as, but not limited to, a U-shaped opening that is sized to accept a damper shaft 32 from the side (see the arrow in FIG. 12), allowing the actuator 10 to be direct coupled to the damper shaft as a side-mount direct coupled actuator, as compared to the end-mount direct coupled actuator depicted in FIGS. 3 and 4. Supporting the embodiment depicted in FIGS. 12 and 13, the hub 14 includes a lower portion 60 and a detachable upper portion 62 so that the hub 14 may be disassembled to allow either insertion or removal of the damper shaft 32 through the channel in the housing 12 from the side of the damper shaft 32. An attachment mechanism, shown as attachment screws 64 in FIG. 12, may be utilized to couple the upper portion 62 and lower portion 60 of the hub 14 to capture the damper shaft 32 between the lower portion 60 and the removable upper portion 62. Other ways of attaching the two portions of the hub 14 may be contemplated by those having skill in the art.

Once attached to one another, the upper portion 62 and lower portion 60 of the hub 14 operate in a similar manner to that described with respect to the actuator embodiments described above. In one embodiment, the attachment screws 64 may be tightened to the degree necessary to accommodate damper shafts of differing sizes, such as by decreasing the size of the aperture within the hub 14 depending on the amount the attachment screws 64 are tightened. Alternatively, the actuator 10 embodiment depicted in FIGS. 12 and 13 may utilize a similar coupling clamp to that shown in FIGS. 3–6. Once the upper portion 62 and lower portion 60 are secured together to capture and secure damper shaft 32 within hub 14, the actuator motor (not shown) may rotate the hub 14 to rotate the damper shaft 32.

While the detailed drawings and specific examples given describe various exemplary embodiments, they serve the purpose of illustration only. It is to be understood that the invention is not limited in its application to the details of construction and the arrangements of components set forth in the preceding description or illustrated in the drawings. For example, the particular components selected to create the torque transfer mechanism may differ depending on the configuration of the actuator and hub. The components shown in FIGS. 1–13 collectively make up a damper actuator system that permits a standard direct coupled damper actuator to be utilized in either an end-mount or side-mount configuration depending on the needs of the user. However, the exemplary embodiments shown in FIGS. 1–13 are but one way to accomplish the overall concept of the present invention. Furthermore, other substitutions, modifications, changes, and omissions may be made in the design, operating conditions, and arrangements of the exemplary embodiments without departing from the scope of the invention as expressed in the appended claims.

What is claimed is:

1. A damper actuator, comprising;

a housing;

a hub rotatably coupled to the housing, the hub defining an aperture through the housing;

a motor coupled to the hub to rotate the hub, and an external clamp operatively coupled to the hub, wherein a torque is transmitted from the hub to the external clamp, wherein the external clamp is configured to be attached to a damper shaft without the damper shaft extending through the aperture, whereby rotation of the hub results in a corresponding rotation of the damper shaft.

2. The damper actuator of claim 1, wherein the torque is transmitted from the hub to the external clamp by a gear train.

3. The damper actuator of claim 2, wherein the gear train comprises a first gear attached to the hub and a second gear rotatably coupled to the housing, the second gear interlocking with the first gear.

4. The damper actuator of claim 3, wherein a portion of the external clamp is integrally formed with the second gear.

5. The damper actuator of claim 1, wherein the external clamp is adjustable to accommodate differently sized damper shafts.

6. The damper actuator of claim 1, wherein the housing comprises a first side and an opposed second side and the external clamp is configured to be attached to the hub on either the first side or the second side of the housing.

7. A damper actuator system, comprising:

a damper actuator having a housing and a hub rotatably coupled to the housing, the hub defining an aperture through the housing;

a first clamp adapted to be directly coupled to the hub to operatively couple a damper shaft to the hub in a first configuration, the damper shaft extending through the aperture in the first configuration; and a second clamp adapted to be attached to the housing to operatively couple the damper shaft to the hub in a second configuration, the damper shaft extending through the second clamp without extending through the aperture in the second configuration;

wherein a torque is transmitted from the hub to the damper shaft via the first clamp in the first configuration and wherein the torque is transmitted from the hub to the damper shaft via the second clamp in the second configuration.

8. The damper actuator system of claim 7, wherein the torque is transmitted from the hub to the second clamp by a gear train.

9. The damper actuator system of claim 8, wherein the gear train comprises a first gear attached to the hub and a second gear rotatably coupled to the housing, the second gear interlocking with the first gear.

10. The damper actuator system of claim 9 wherein a portion of the second clamp is integrally formed with the second gear.

11. The damper actuator system of claim 7, wherein the damper actuator comprises a first side and an opposed second side and the first clamp is configured to be attached to the hub on either the first side or the second side of the damper actuator.

12. The damper actuator system of claim 11, wherein the second clamp is configured to be attached to the hub on either the first side or the second side of the damper actuator.

13. A damper actuator, comprising;

a housing;

a hub extending through and rotatably coupled to the housing;

a motor coupled to the hub to rotate the hub;

an external clamp coupled to the housing, wherein the external clamp is configured to be attached to a damper shaft without the damper shaft extending through the hub; and a torque transfer mechanism coupled between the hub and the external clamp, wherein rotation of the hub results in a corresponding rotation of the damper shaft.

14. The damper actuator of claim 13, wherein the torque transfer mechanism is a gear train.

15. The damper actuator of claim 14, wherein the gear train comprises a first gear attached to the hub and a second gear rotatably coupled to the housing, the second gear interlocking with the first gear.

16. The damper actuator of claim 15, wherein a portion of the external clamp is integrally formed with the second gear.

17. The damper of claim 13, wherein the housing comprises a first side and an opposed second side and the external clamp is configured to be attached to the hub on either the first side or the second side of the housing.

18. A damper actuator, comprising;

a housing;

a hub rotatably coupled to the housing, the hub defining an aperture through the housing;

a motor coupled to the hub to rotate the hub; and a means for operatively coupling the hub to a damper shaft without the damper shaft extending through the aperture, wherein rotation of the hub results in a corresponding rotation of the damper shaft.

19. The damper actuator of claim 18, wherein the means for operatively coupling the hub to the damper shaft comprises an external clamp.

20. The damper actuator of claim 19, wherein the means for coupling the hub further comprises a gear train configured to transfer a torque from the hub to the external clamp.

21. The damper actuator of claim 20, wherein the gear train comprises a first gear attached to the hub and a second gear rotatably coupled to the housing, the second gear interlocking with the first gear.

22. The damper actuator of claim 21, wherein a portion of the external clamp is integrally formed with the second gear.

23. The damper actuator of claim 19, wherein the external clamp is adjustable to accommodate differently sized damper shafts.

24. The damper actuator of claim 18, wherein the housing comprises a first side and an opposed second side and the means for operatively coupling the hub to the damper shaft is configured to be attached to the hub on either the first side or the second side of the housing.

25. A side-mount direct coupled damper actuator, comprising;

a housing having a substantially U-shaped opening configured to receive a damper shaft from a side of the damper shaft;

a hub rotatably coupled to the housing, the hub having a first portion and a removable second portion configured to capture the damper shaft between the first portion and the removable second portion; and a motor coupled to the hub to rotate the hub.

26. The damper actuator of claim 25, wherein the first portion and the removable second portion are coupled together by one or more screws.

27. The damper actuator of claim 25, further comprising a coupling clamp adapted to secure the damper shaft to the hub.

28. The damper actuator of claim 27, wherein the coupling clamp is adjustable to accommodate differently sized damper shafts.

29. The damper actuator of claim 25, wherein the first and second portion of the hub are adjustable to accommodate differently sized damper shafts.

* * * * *